US005367117A

United States Patent [19]

Kikuchi

[11] Patent Number: 5,367,117

[45] Date of Patent: Nov. 22, 1994

[54] MIDI-CODE GENERATING DEVICE

[75] Inventor: Takeshi Kikuchi, Hamamatsu, Japan

[73] Assignee: Yamaha Corporation, Hamamatsu, Japan

[21] Appl. No.: 752,034

[22] Filed: Aug. 29, 1991

[30] Foreign Application Priority Data

Nov. 28, 1990 [JP] Japan ..... 2-328395

[51] Int. Cl.[5] ..... G10H 7/00

[52] U.S. Cl. ..... 84/603; 84/645; 84/616

[58] Field of Search ..... 84/603, 645, 600, 615–617, 84/647, 653, 654, 661, 681, 700, 736, 453, 454, 18, 655, 682, DIG. 7, 18; 381/83, 93; 324/77 C, 78 F, 78 D

[56] References Cited

U.S. PATENT DOCUMENTS

| | | | |
|---|---|---|---|
| 4,014,237 | 3/1977 | Milde, Jr. | 84/453 X |
| 4,041,783 | 8/1977 | Shimauchi et al. | 84/454 X |
| 4,282,786 | 8/1981 | Deutsch et al. | 84/DIG. 22 |
| 4,399,732 | 8/1983 | Rothschild et al. | 84/454 |
| 4,432,096 | 2/1984 | Bunge | 381/43 |
| 4,513,189 | 4/1985 | Ueda et al. | 219/10.55 B |
| 4,843,562 | 6/1989 | Kenyon et al. | 381/43 X |
| 5,119,432 | 6/1992 | Hirsch | 381/45 X |
| 5,142,961 | 9/1992 | Paroutaud | 84/645 X |
| 5,202,528 | 4/1993 | Iwaooji | 84/616 |

FOREIGN PATENT DOCUMENTS

| | | | |
|---|---|---|---|
| 3-41498 | 2/1991 | Japan | 84/645 |

OTHER PUBLICATIONS

Fairlight Instruments, "Voicetracker" product preview, dated 1985.

"Transcription-System for Polyphonic Music", Haruhiro Katayose, et al., Osaka University, pp. 8–13 (1987).

*Primary Examiner*—William M. Shoop, Jr.
*Assistant Examiner*—Brian Sircus
*Attorney, Agent, or Firm*—Spensley Horn Jubas & Lubitz

[57] ABSTRACT

A MIDI-code generating device utilizing a musical instrument for producing a plurality of musical tones which comprise a fundamental tone and a harmonic tone corresponding to the fundamental tone, the fundamental and harmonic tones being discrete frequencies and having different envelope wave-forms, includes a microphone for converting a produced musical tone from the musical instrument into an electrical audio signal, an A/D converter for converting the electrical audio signal into digital signal of wave-form data, a group of band-pass filters for extracting wave-form data having frequency component respectively corresponding to each of the fundamental tones, from wave-form data outputted by the A/D converter, an envelope detection circuit for detecting envelope data of wave-form data extracted by the group of band-pass filters, a memory for storing reference envelope data of the fundamental tone corresponding to the envelope wave-form of each fundamental tone of the musical tones produced by the musical instrument, a fundamental tone decision circuit for comparing envelope data detected by the envelope detection circuit with fundamental tone envelope data stored in the memory, and for deciding on a produced fundamental tone when the musical tone is produced by the musical instrument, and a coding circuit for generating a MIDI-code according to a result of a decision of the fundamental tone decision circuit and the detected envelope data.

6 Claims, 5 Drawing Sheets

MIDI-CODE GENERATING DEVICE

BACKGROUND OF THE INVENTION

1. Field of the Invention

The present invention relates to an MIDI-code generating device which generates an MIDI (Musical Instrument Digital Inter face) code for controlling the performance of the electronic instrument by extracting the volume and time interval between key depression and key release of each musical interval played on such instruments as a piano.

2. Prior Art

As for automatic performance pianos, there are ones having record and playback functions and others having playback functions only. For those which only have playback functions, it is possible to do automatic performance based on input MIDI-code, but the live (actual) tone played by the musician cannot be changed to MIDI-code and be stored. At this point, a device becomes necessary which generates MIDI-code performance by extracting the volume and time interval between key depression and key release of each musical interval, played on such instruments as a piano. As for such kind of devices in prior art, the live tone is transformed into an electric audio signal; then after this audio signal has been transformed into a digital signal, the power spectrum of each frequency corresponding to a musical interval is computed. Based on the power spectrum, successively calculated on each musical interval, a device for generating an MIDI-code representing the time interval between key depression and key release of each musical interval and the volume is proposed.

On pianos and other musical instruments where a plurality of keys may be pressed at the same time and a polyphonic tone is produced, even simply requesting a power spectrum of each musical interval, as mentioned above, brings the desire of improvement, since the generated MIDI-code is different from the original performance. In other words, in a power spectrum calculated successively on each musical interval, the intervals of the keys actually depressed, that is, not only a power spectrum which suits to the fundamental tone, but also power spectra which suit to the harmonic tones (harmonic components), are mostly included. According to this, an MIDI-code of the interval corresponding to this harmonic tone is generated; though a key has not been depressed, an additional MIDI-code is generated, as if a key had been depressed.

Therefore a device is proposed which refers to a ratio-table storing the ratio of the level of the fundamental tone to the level of the harmonic tone and decides the fundamental tone and the harmonic tone. However, in case of depressing several keys at the same time, the fundamental tones cannot be decided with certainty. Also, there is the problem that the fundamental tones which relates to a plurality of frequencies has to be decided at the same time, and the problem of time necessary for processing.

SUMMARY OF THE PRESENT INVENTION

Therefore, it is an object of the present invention to provide a MIDI-code generation device generating in a short time a MIDI-code, precisely corresponding to the original performance of a musical instrument, such as a piano, and simultaneously producing a plurality of fundamental tones and harmonic tones thereof.

MIDI-code generating devices in accordance with the invention utilize a musical instrument to produce a plurality of musical tones which comprise a fundamental tone and a harmonic tone corresponding to the fundamental tone. The fundamental and harmonic tones are discrete frequencies and have different envelope wave-forms. Conversion apparatus converts a produced musical tone from the musical instrument into an electrical audio signal, which in turn is converted into a digital signal having wave-form data. A group of band-bass filters extract wave-form data having frequency components respectively corresponding to each of the fundamental tones, from the wave-form data of the conversion apparatus. Envelope detection apparatus detects envelope data of the wave-form data extracted by the group of band-pass filters. Fundamental tone envelope storage apparatus stores reference envelope data of the fundamental tone corresponding to the envelope wave-form of each fundamental tone of the musical instrument. Fundamental tone decision apparatus compares envelope data detected by the envelope detection apparatus with reference fundamental tone envelope data stored in the fundamental tone envelope apparatus to determine a produced fundamental tone when the musical tone is produced by the musical instrument. Coding means generates a MIDI-code according to a result of a decision of the fundamental tone decision apparatus and the envelope data detected by the envelope detection apparatus. Such MIDI-code corresponds to the musical tones produced by the musical instrument.

With the above construction, envelope data detected by envelope detection apparatus and envelope data of fundamental tones stored beforehand in fundamental tone envelope storage apparatus are compared by cross correlation, as the fundamental tone produced by the musical instrument can be decided, and the fundamental tone can be instantly and certainly decided. Thus the MIDI-code precisely equivalent to the original performance can be generated in a short time.

DESCRIPTION OF THE PREFERRED EMBODIMENTS

The preferred embodiment of the present invention will herein be explained with reference to the diagrams.

Figure 1:
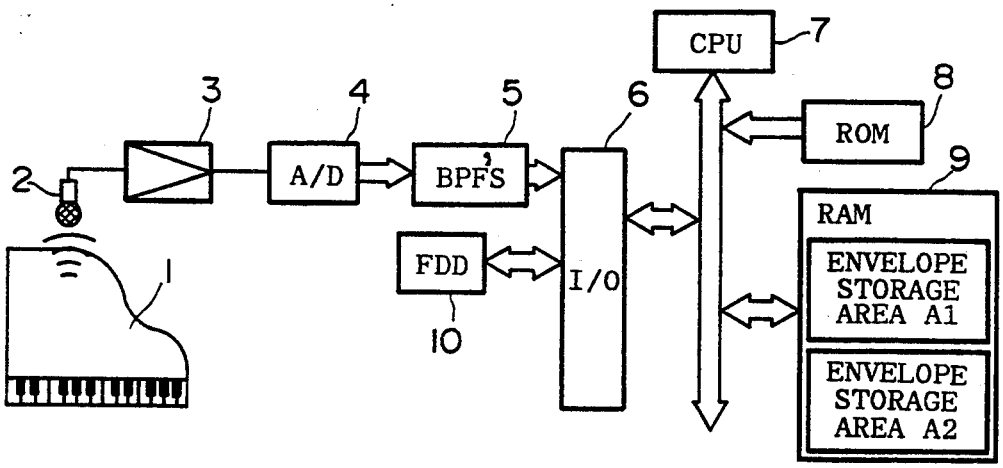
FIG. 1 is a block diagram of the embodiment of the present invention.
Figure 2:
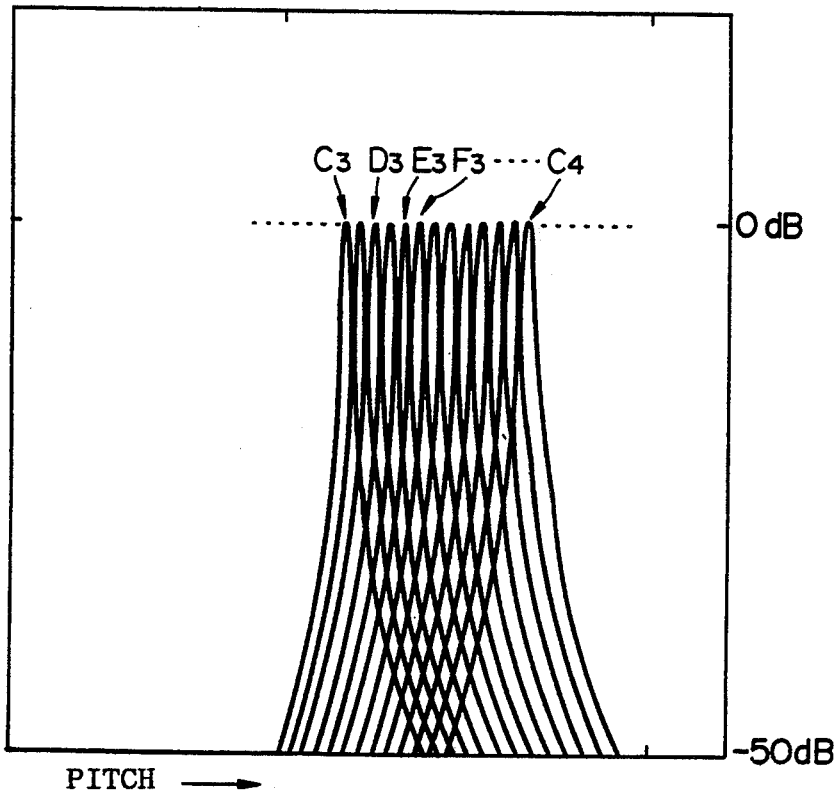
FIG. 2 is a diagram of the characteristic of the pass band of the band pass filter group used in the same embodiment of the present invention.

FIG. 1 is a block diagram of the embodiment of the present invention. In this figure, there is a piano 1. By a microphone 2 the musical tone of this piano 1 is transformed to an audio signal which is amplified by an amplifier 3 and then transferred to an A/D converter 4. This A/D converter 4 samples the analog audio signal coming from amplifier 3 at a certain period, successively transforms it to digital wave-form data and supply to a group of digital BPF 5 (band pass filters). This group of digital BPF 5, for example, is formed by a DSP (digital signal processor) which is a processor of stored program type making real time signal processing possible and works as a band pass filter having a variety of pass band characteristics stored beforehand by a process program for filter operation. In this case, as shown in FIG. 2, it has the characteristic of a pass band peaking at all pitches of the fundamental tones which are produced when all keys (e.g. . . . $C_3$, $D_3$, $E_3$, . . . , $C_4$ . . . ) of piano 1 are depressed. The wave-form data (however, wave-form data of harmonic tones are also included) of the frequency components corresponding to all fundamental tones, thus extracted by the group of digital BPF 5, are applied to I/O circuit 6.

CPU 7 (central processing unit) executes a program for all kinds of operation processing used for generating a MIDI-code as stated below. ROM 8 (read only memory) stores the program executed by CPU 7, RAM 9 (random access memory) stores temporarily various data of the processing. The above mentioned all parts and also I/O circuit 6 are mutually connected via the system bus.

In said RAM 9 two storage areas A1 and A2 are set up. In storage area A1 for the envelope of the fundamental tones, the envelope data BENV of the fundamental tones corresponding to the wave-form of the envelope of all fundamental tones, produced when key of musical instrument 1 are depressed, are stored beforehand by pitch according to each fundamental tone. The wave-form data of the envelope supplied by the group of digital BPF 5 are stored in envelope storage area A2 as envelope data ENV by pitch corresponding to the fundamental tones. In said storage area A1 for the envelope of the fundamental tones, the data corresponding to the differentiated envelope wave-forms of all fundamental tones are stored as BENV data of the envelope of the fundamental tones. Thus, the operation process of cross correlation value simplified and shortened as stated hereafter. Floppy disk device 10 (FDD) stores the MIDI-code of at least one part of the melody generated by CPU 7.

Flowcharts 3 and 4 are referred to for explaining the action of the preferred embodiment.

Figure 3:
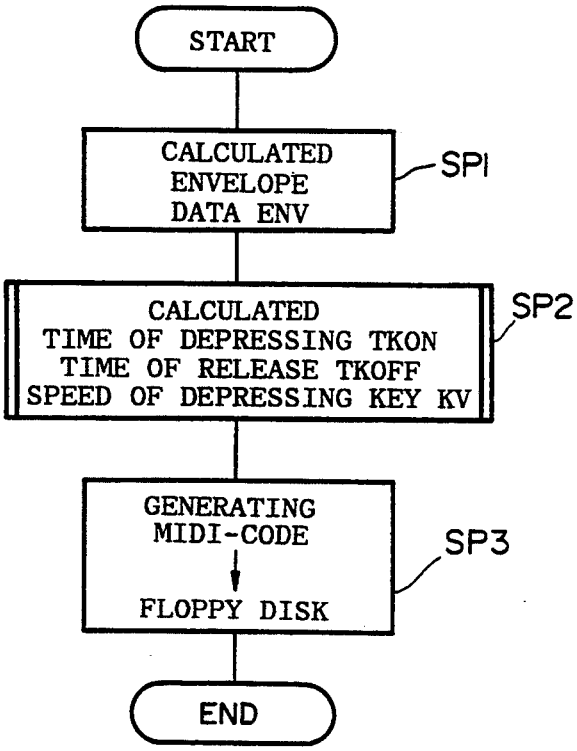
FIGS. 3 and 4 are flowcharts explaining the action of the same embodiment.

In step SP1 of FIG. 3, when a musician plays the piano 1, CPU 7 calculates the envelope of the wave-form data of the frequency components corresponding to the fundamental tones successively outputted by the group of band-pass filters 5 and stores the calculated envelope data ENV by pitches according to the fundamental tones, successively into storage area A2 for the envelope data in RAM 9 according to lapse of time.

Figure 5:
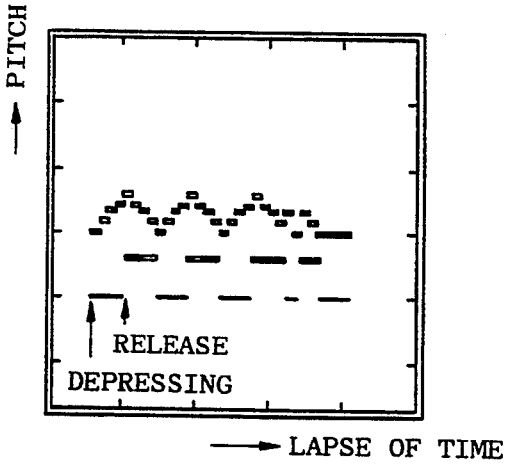
FIG. 5 is an example of performance data inputted into the same embodiment.
Figure 6:
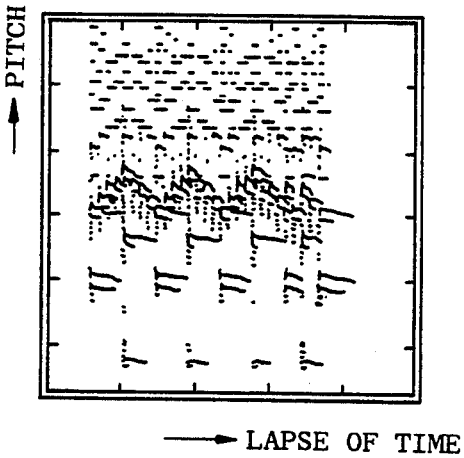
FIG. 6 is an envelope map generated in the same embodiment.
Figure 9:
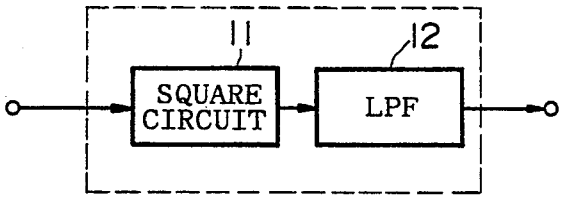
FIG. 9 is a block diagram explaining the process applied in the same embodiment for calculating the envelope.

Therefore, for example, a person plays a melody as shown in FIG. 5, the envelope data ENV corresponding to the envelope map shown in FIG. 6, are stored in envelope storage area A2. In this Figure the y-axis(vertical) shows the pitch and the x-axis (horizontal) shows the lapse of time. The vertical position of each rectangle shown in FIG. 5 shows the pitch of the key actually depressed, the left end shows the time when the key was depressed (key-on), the right end shows when the key was released (key-off) and the width of the vertical toward of the rectangle shows the speed of depressing (velocity). In the envelope map shown In FIG. 6, besides the envelope of the fundamental tone corresponding to the key actually depressed, the included envelope of the harmonic tones can also be seen. The envelope can be detected by square circuit 11 and lowpass-filter 12 which is connected to the square circuit 11 in series as shown in FIG. 9, or the software which has a same function as a circuit of FIG. 9.

In the next step SP 2, for each fundamental tone corresponding to each key, the calculation of time of depressing the key TKON, the time of release TKOFF and the speed of depressing the key KV, are calculated in a parallel process, and in the next step SP 3, based on these calculated data, the MIDI-code is generated and stored on floppy disk FD via the floppy disk device.

Figure 4:
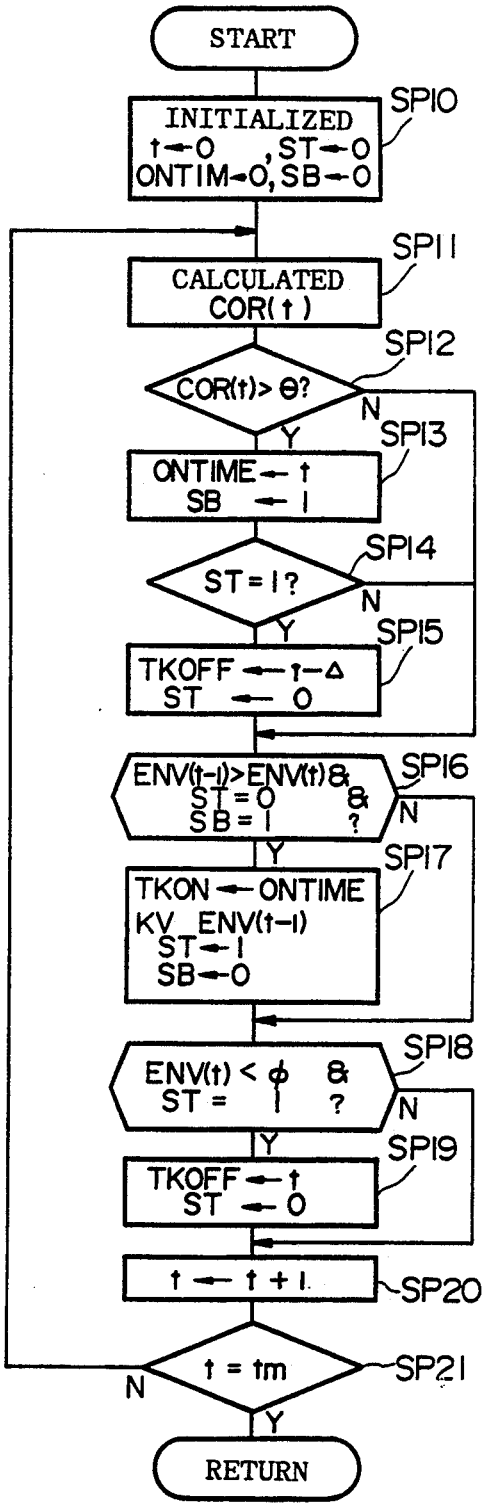

Then, in said step SP 2, the process executed in parallel for each fundamental tone is shown in FIG. 4.

In step SP 10 of FIG. 4, the time data t initialized with t=0, corresponding to the process time of the performance, the on timing data showing the time of depressing a key is initialized with ONTIME=0, the status flag showing the state of depressing a key is initialized with ST=0 and the standby flag showing whether or not the detection of the time of depressing ended, is initialized with SB=0. In this case the status flag ST=0 indicates the status of key releasing, status flag ST=1 indicates the status of key depressing, standby flag SB=0 indicates the status that the detection of the time of depressing a key has not been finished, and standby flag SB=1 indicates the status that the detection of the time of depressing a key has been finished.

In the next step SP 11, in order to determine the similarities between the envelope data BENV of the fundamental tones stored in storage area A1 for the envelope of the fundamental tones and the envelope data ENV stored in envelope storage area A2, their cross correlation data COR(t) are calculated.

Figure 10:
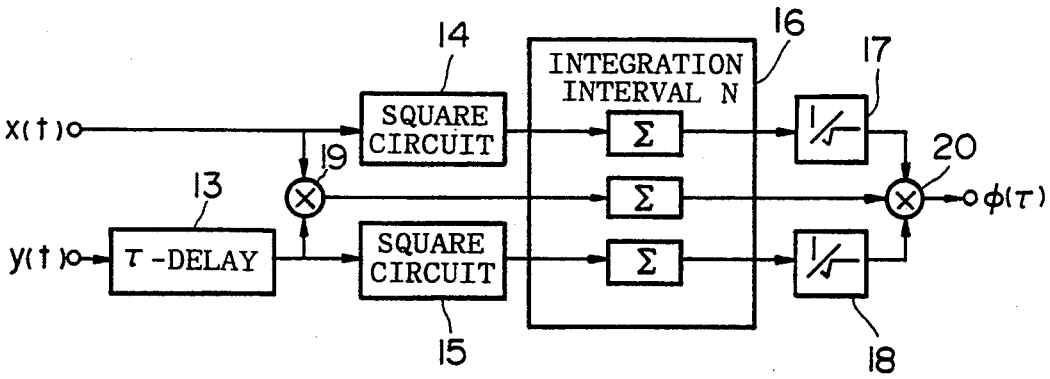
FIG. 10 is a block diagram explaining the process applied in the same embodiment for calculating the cross correlation coefficients.

The cross correlation method is known as the standard method for finding similarities between signal x(t) and signal y(t). So the cross relation coefficient $\phi(\tau)$ can be determined by using $$\phi(\tau) = \frac{\sum_{i}^{n} x_i \cdot y_{i+\tau}}{\sqrt{\sum_{i}^{n} x_i^2} \cdot \sqrt{\sum_{i}^{n} y_{i+\tau}^2}} \quad (1)$$

when the length of the interval for comparing the wave-forms is set n. If $abs(\phi(\tau)) \leqq 1$ and $x(t)=y(t)$, then $\phi(\tau)=1$. The closer $\phi(\tau)$ gets to 1, the greater the decided similarity of signal x(t) and signal y(t). The calculation of the cross correlation value $\phi(\tau)$ of signals x(t) and y(t) is done by a combined circuit of delay circuit 13, square circuits 14 and 15, integration circuit 16, square root extraction circuits 17 and 18, adder circuits 19 and 20 as shown in FIG. 10 or software with the same functions.

In the above stated step SP 11, the envelope data of fundamental tones BENV(t) are read out of storage area A1 for the envelope of the fundamental tones and assigned to signal x(t) in equation (1), the envelope data ENV are read out from storage area A2 of envelope data and input into the differential filter, the differentiated envelope data DENV(t) thus obtained are assigned to signal y(t) of equation (1) and the thus obtained cross correlation value $\phi(\tau)$ are assigned to COR(t).

In the following step 12, depending on whether or not the cross correlation data calculated in SP 11 exceed a fixed threshold value $\theta$ (for example $\theta=0.9$), the similarity of fundamental tone envelope data BENV(t) and envelope data DENV(t) is examined. Then, If cross correlation data $COR(t)>\theta$, similarity is decided and step SP 14 follows. If cross correlation data $COR(t)\leqq\theta$, there is a jump to step SP 16.

In step SP 13, the time data t corresponding to the elapse time at this moment is assigned to the oncoming data ONTIME. After standby flag is set to SB=1, step SP 14 follows.

In step SP 14, it is decided whether or not status flag ST=1. If it is decided according to status flag ST=1 that a key is being depressed, step SP 15 follows next. If it is decided according to status flag ST=0 that a key is not being depressed, step SP 16 follows next. If a new key-on event occurs under the condition that a key is being depressed continuously, so that ENV(t) is not less than a fixed threshold value $\phi$ to decide a key-off condition as described below, the status flag is set to be ST=1 in step SP 14, and step SP 15 follows next.

In this step SP 15, a small time interval $\Delta$ (for example, a suitable value in the range of 0.1 sec) is subtracted from the elapse time data t at this moment, and the resulting time data (t−1) is assigned to the release time data TKOFF. By this, the release time data TKOFF is compulsorily set equal to the point of time just before the new key-on event occurred. Then, after having set status flag ST=0, step SP 16 follows next.

In this step SP 16, the envelope data ENV(t−1) and the present envelope data ENV(t) are compared, and if ENV(t−1)>ENV(t), status flag ST=0 and standby flag SB=1, that is, no key is being depressed, when it is decided that envelope data ENV(t−1) have their peak value, it is regarded that the first key-on event has occurred, and step SP 17 follows next; if the conditions are not fulfilled, there is a jump to step SP 18.

In step SP 17, the on-timing data ONTIME obtained from step SP 13, is assigned to key depression time data TKON. Then after the key depression speed data KV are set to the value in proportion to envelope data ENV(t−1) which are the peak values, status flag ST=1 and standby flag SB=0 is set. Step SP 18 follows next.

In step SP 18, it is decided whether or not envelope data ENV(t) are less than a fixed threshold value decoding the released key state. Then, if envelope data ENV(t)<$\phi$ and status flag ST=1, it is regarded that a key-off event has occurred, and step SP 19 follows next. If these conditions are not fulfilled, there is a jump to step 20.

Then, in step SP 19, the time data t of the moment the key-off event is being considered to happen is assigned to the key release time data TKOFF. After status flag ST=0 has been set, step SP 20 follows next.

In this step SP 20, after time data t has been incremented by +1, step SP 21 follows next. In the step SP 21, if it is decided that the time data t has not reached a final value tm, there is a jump back to step SP 11 and the steps stated above are repeated. If it is decided that time data t=tm, the above stated sequence process stops and turns back to step SP 3 shown in FIG. 3.

Figure 7:
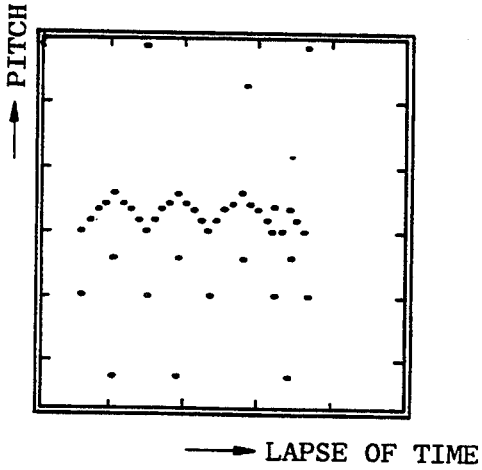
FIG. 7 is a map of depressed keys of fundamental tones generated in the same embodiment.
Figure 8:
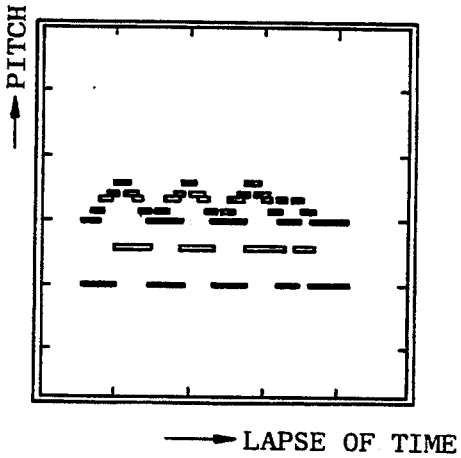
FIG. 8 is a MIDI-code map generated in the same embodiment.

By executing above mentioned process in parallel on every fundamental tone, corresponding to each key, for example when performing like shown In FIG. 5, by above said process, a map of depressed keys of fundamental tones cleared of all harmonic components is generated as shown in FIG. 7, and then, an MIDI-code map, surely corresponding to the original performance is generated as shown in FIG. 8.

Figures 11A, 11B, 11C:
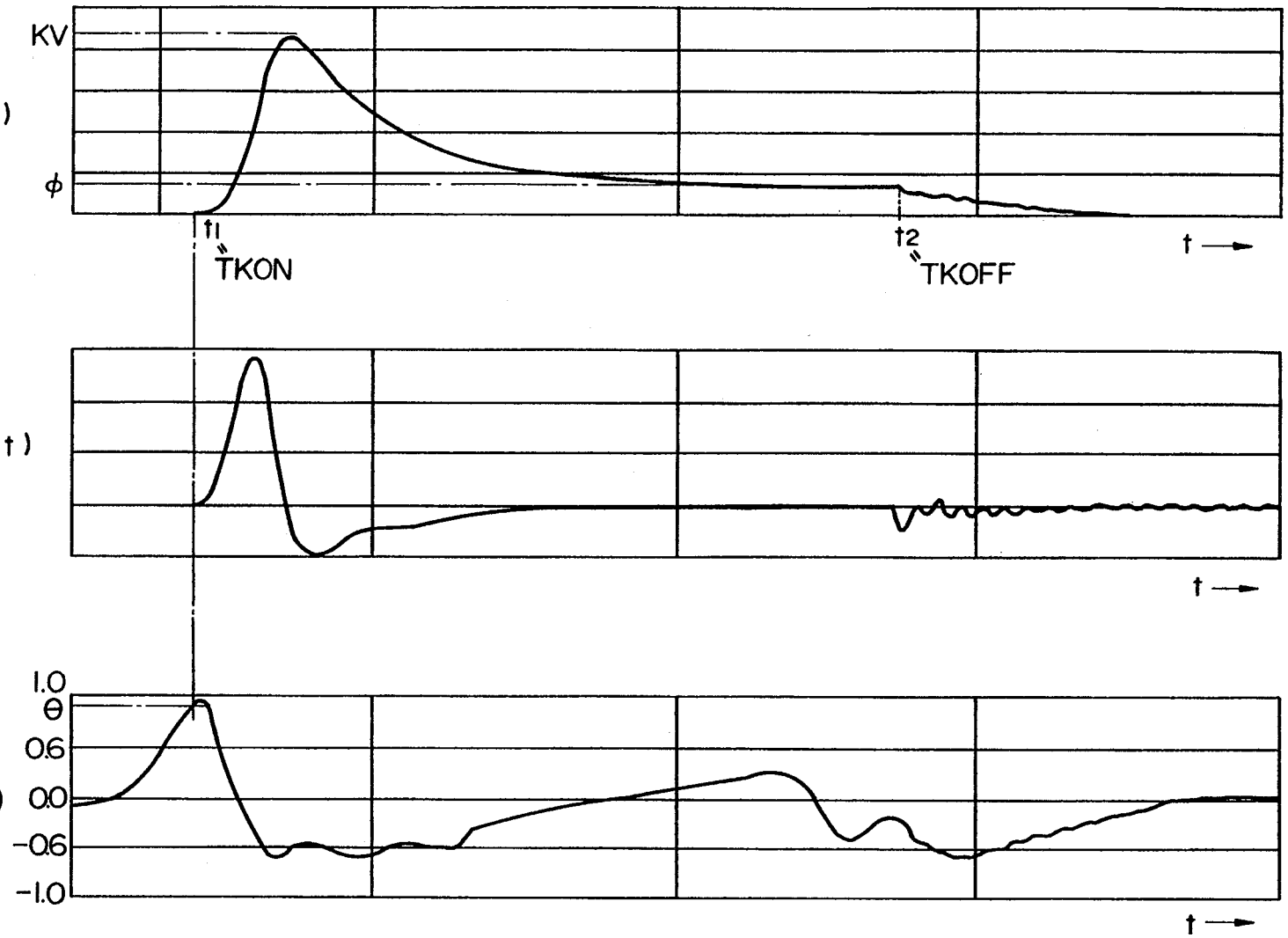
FIGS. 11A to 11C are curves for explaining the data transformation calculated in the same embodiment.

Therefore, for example, an explanation is given on, when from changed envelope data ENV(t) corresponding to time elapse as shown in FIG. 11A key depression time data TKON, key release time data TKOFF and key depression speed data KV are calculated. First, differentiated envelope data DENV(t) as shown in the FIG. 11B are necessary, then, cross correlation data COR(t) as shown in FIG. 11C is calculated from fundamental tone envelope data BENV(t) which were read out from fundamental tone storage area A1, and the envelope data DENV(t). Then at a certain time t1, when cross correlation data COR(t) exceed a fixed threshold value $\theta$, it is regarded as an occurrence of a key-on event, key depression time TKON is set to time t1 and depression speed data KV is set to the peak value of envelope data ENV(t). After this, at the time when time t2 becomes less than a fixed threshold value $\phi$, envelope data ENV(t) are regarded as a key-off occurrence and key release time data TKOFF is set to this time t2. Then, key depression time data TKON, key release time data TKOFF and key depression speed data KV are decided on the basis of envelope data ENV(t).

In above mentioned preferred embodiment, for storing the MIDI-code generated by CPU 7, a floppy disk devlce 10 served as an example for explaining, but the use of a semi-conductor memory or a tape recorder, of course, does not matter.

What is claimed is:

1. A MIDI-code generating device for generating a MIDI-code corresponding to sound produced by a musical instrument, comprising:

a musical instrument for producing a plurality of musical tones which comprise a fundamental tone and a harmonic tone corresponding to the fundamental tone, the fundamental and harmonic tones being discrete frequencies and having different envelope wave-forms;

conversion means for converting a produced musical tone from the musical instrument into an electrical audio signal and converting the electrical audio signal into a digital signal having wave-form data;

a group of band-pass filters for extracting wave-form data having frequency components respectively corresponding to each of the fundamental tones, from wave-form data outputted by the conversion means;

envelope detection means for detecting envelope data of wave-form data extracted by the group of band-pass filters;

fundamental tone envelope storage means for storing reference envelope data of the fundamental tone corresponding to the envelope wave-form of each fundamental tone of the musical tones produced by the musical instrument;

fundamental tone decision means for comparing envelope data detected by the envelope detection means with reference fundamental tone envelope data stored in the fundamental tone envelope means to determine a produced fundamental tone when the musical tone is produced by the musical tone producing means; and coding means for generating a MIDI-code according to a result of a decision of the fundamental tone decision means and the envelope data detected by the envelope detection means, the MIDI-code corresponding to the musical tones produced by the musical instrument.

2. A MIDI-code generating device according to claim 1 wherein said band-pass filter group comprises a processor of stored program type executing real time digital signal processing and forming a plurality of pass-band characteristics.

3. A MIDI-code generating device according to claim 1 wherein said fundamental tone envelope storage means stores wave-form data of each fundamental tone envelope differentiated by a differential filter.

4. A MIDI-code generating device according to claim 1 wherein said fundamental tone decision means compares the detected envelope data with the stored envelope data by cross correlation, and determines production of the fundamental tone when a comparison result is over a predetermined value.

5. A method for detecting a fundamental tone comprising the steps of:

operating a musical instrument to produce a plurality of musical tones which comprise a fundamental tone and a harmonic tone corresponding to the fundamental tone, the fundamental and harmonic tones being discrete frequencies and having different envelope wave-forms;

collecting a produced musical tone as an analog audio signal;

converting the analog audio signal into a digital signal having wave-form data;

extracting wave-form data having frequency components respectively corresponding to each of the fundamental tones, from the wave-form data;

detecting envelope data of the extracted wave-form data;

storing reference envelope data of the fundamental tone corresponding to the envelope wave-form of each fundamental tone of the musical tones;

comparing the detected envelope data with the stored reference envelope data of the fundamental tone; and determining production of the fundamental tone according to a result of the comparison.

6. A MIDI-code generating device according to claim 5 further comprising the step of:

generating a MIDI-code according to a result of the determining of the production of the fundamental tone and the detected envelope data.

* * * * *